US006622783B2

(12) United States Patent
Hitt et al.

(10) Patent No.: US 6,622,783 B2
(45) Date of Patent: Sep. 23, 2003

(54) SELF-FIXTURING FAN SHROUD

(75) Inventors: Jonathan M. Hitt, Racine, WI (US); Gregg D. Olson, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/929,576

(22) Filed: Aug. 14, 2001

(65) Prior Publication Data

US 2003/0034153 A1 Feb. 20, 2003

(51) Int. Cl.[7] ..... F01P 5/02

(52) U.S. Cl. ..... 165/121; 165/78; 165/122; 165/51; 165/140; 180/68.1; 123/41.49

(58) Field of Search ..... 165/122, 121, 165/78, 51; 123/41.49; 180/68.1

(56) References Cited

U.S. PATENT DOCUMENTS

| | | | | |
|---|---|---|---|---|
| 3,795,274 A | * | 3/1974 | Fieni | 165/122 |
| 4,962,734 A | | 10/1990 | Jorgensen | |
| 5,474,121 A | * | 12/1995 | Bryson et al. | 165/122 |
| 5,522,457 A | | 6/1996 | Lenz | |
| 5,623,893 A | | 4/1997 | Bartz et al. | |
| 5,626,202 A | | 5/1997 | Barnes et al. | |
| 5,649,587 A | | 7/1997 | Plant | |
| 5,704,418 A | * | 1/1998 | Baader et al. | 165/121 |
| 5,875,836 A | * | 3/1999 | Nakamura | 165/122 |
| 6,189,492 B1 | * | 2/2001 | Brown | 123/41.49 |

FOREIGN PATENT DOCUMENTS

| | | | |
|---|---|---|---|
| WO | 26599 | * | 5/2000 |

* cited by examiner

*Primary Examiner*—Leonard Leo
(74) *Attorney, Agent, or Firm*—Wood, Phillips, Katz, Clark & Mortimer

(57) ABSTRACT

A self-fixturing fan shroud (12) for use with a heat exchanger assembly (13), the heat exchanger assembly (13) includes an upper horizontal surface (16), a lower, upwardly opening, horizontal channel (18), and at least one core (14 or 15) extending between the upper horizontal surface (16) and the channel (18). Each of the cores (14 and 15) has a front face (24), a back face (26), and air flow passages extending from the front face (24) to the back face (26). The fan shroud (12) comprises a covering portion (28) having an opening (30) disposed therethrough. The opening (30) is of a predetermined size sufficient to receive a fan. An upper horizontal flange (38) extends from the covering portion (28) to rest on the upper horizontal surface (16) of the heat exchanger assembly (13) to vertically locate the fan shroud (12) relative to the heat exchanger assembly (13). A lower vertical flange (40) extends downwardly from the covering portion (28) to be received in the lower horizontal channel (18) of the heat exchanger assembly (13) to restrict movement of the fan shroud (12) away from the heat exchanger assembly (13).

4 Claims, 3 Drawing Sheets

SELF-FIXTURING FAN SHROUD

FIELD OF THE INVENTION

The present invention relates generally to fan shrouds for use in combination with heat exchangers, such as radiators, and more particularly to a structure for attaching a fan shroud to a core of a heat exchanger.

BACKGROUND OF THE INVENTION

In the automotive industry, fan shrouds are widely used today to cover the back faces of heat exchangers, such as radiators and condensers, to increase the flow of air drawn through the heat exchanger core by a fan.

The fan shroud is typically mounted to the heat exchanger with a plurality of fasteners or other attaching elements. The fasteners may be bolts threaded into apertures in the heat exchanger. Alternatively, there may be one or more threaded studs extending from the heat exchanger over which the fan shroud is placed, with one or more nuts being threaded down to clamp the fan shroud in place. Other structures are known that do not rely, at least exclusively, on such conventional fasteners. Representative disclosures of such structures include Bryson et al U.S. Pat. No. 5,474,121, Bryson at al U.S. Pat. No. 5,626,202, Nakamura U.S. Pat. No. 5,875,836 and Baader U.S. Pat. No. 5,704,418.

While many of those known mounting and attachment structures may perform satisfactorily for their intended purpose, there is always room for improvement.

SUMMARY OF THE INVENTION

In accordance with the invention a self-fixturing fan shroud is provided for use with a heat exchanger assembly. The heat exchanger assembly includes an upper horizontal surface, a lower, upwardly opening, horizontal channel, and at least one core extending between the upper horizontal surface and the channel. The at least one core has a front face, a back face, and air flow passages extending from the front face to the back face.

In one embodiment the fan shroud comprises a covering portion having an opening disposed therethrough. The opening is of a predetermined size sufficient to receive a fan. An upper horizontal flange extends from the covering portion to rest on the upper horizontal surface of the heat exchanger assembly to vertically locate the fan shroud relative to the heat exchanger assembly. A lower vertical flange extends downwardly from the covering portion to be received in the lower horizontal channel of the heat exchanger assembly to restrict movement of the fan shroud away from the heat exchanger assembly.

In one form of the invention, the upper horizontal flange of the fan shroud extends substantially the length of the at least one core.

DESCRIPTION OF THE PREFERRED EMBODIMENTS

A self-fixturing fan shroud 12 embodying the invention is illustrated in FIGS. 1–5 in connection with a heat exchanger assembly 13 including a pair of cores 14 and 15 for air cooling two different mediums. However, it should be understood that the invention can be used with other types of heat exchanger assemblies, including assemblies with only one core, or with more than two cores.

Figure 1:
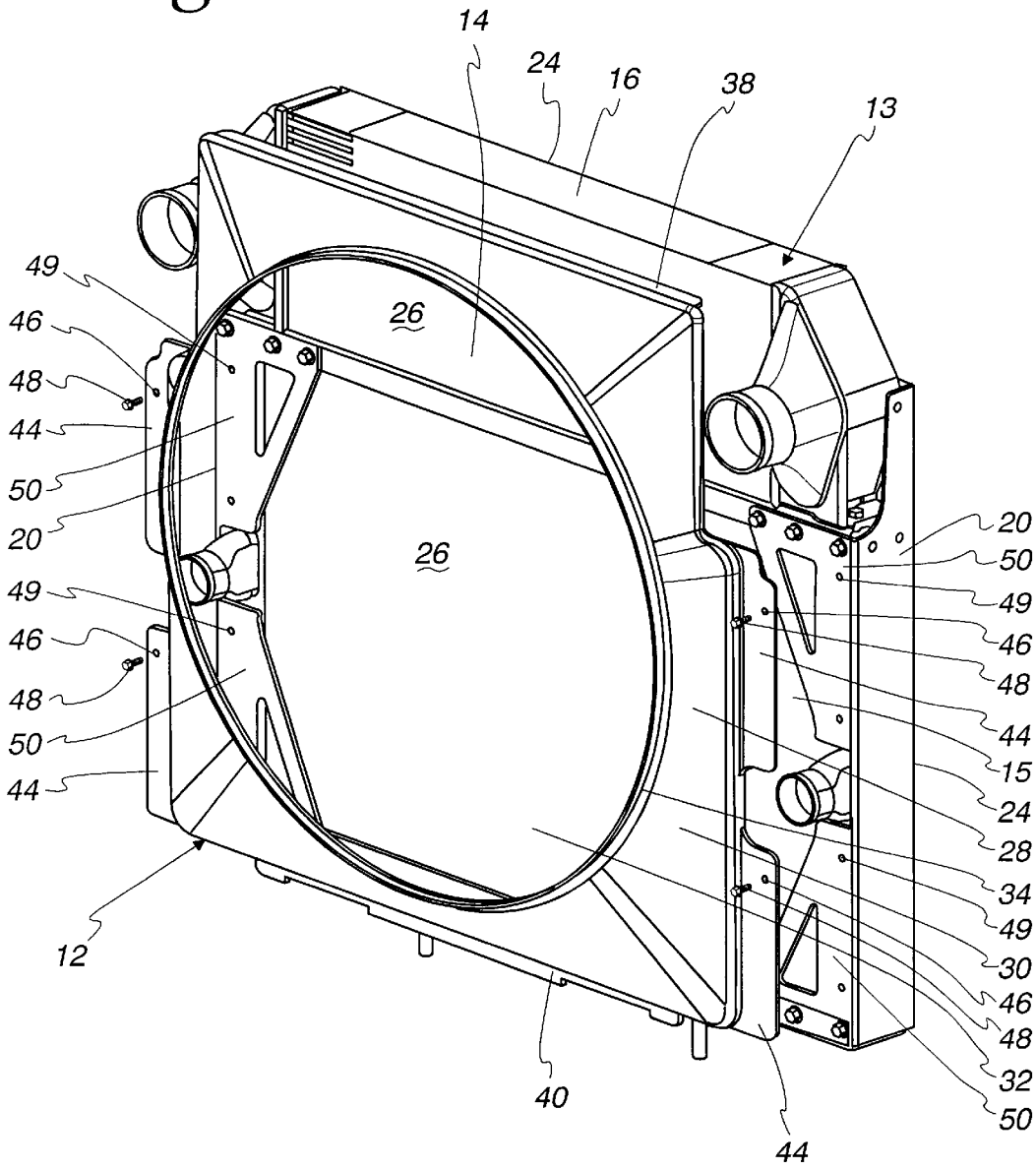
FIG. 1 is an exploded perspective view showing a structure to attach a fan shroud to a heat exchanger assembly in accordance with one embodiment of the invention.
Figure 2:
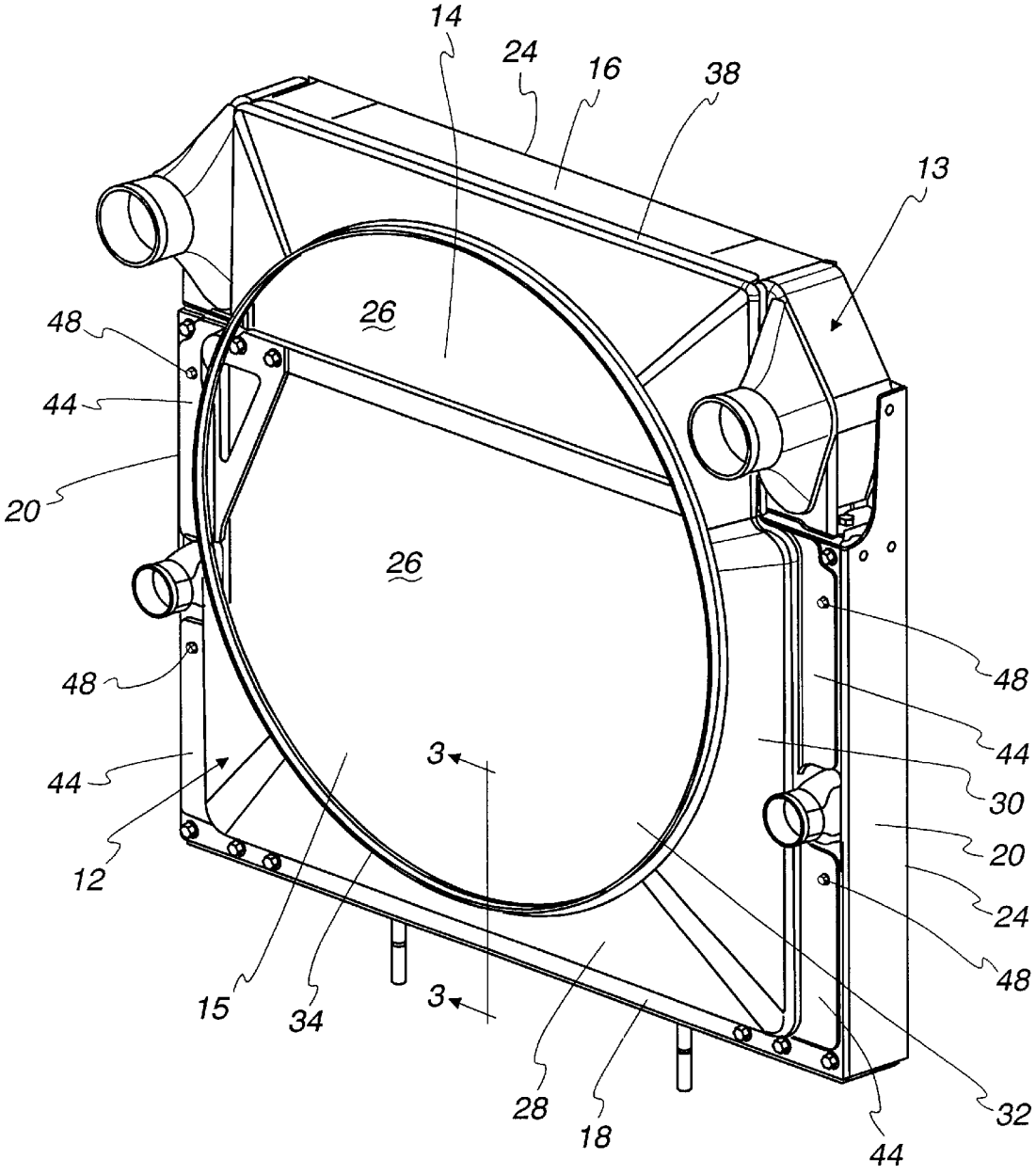
FIG. 2 is an perspective view showing the fan shroud of FIG. 1 assembled to the heat exchanger assembly.

Referring to FIGS. 1 and 2, the heat exchanger assembly 13 includes an upper horizontal surface 16, a lower, upwardly opening, horizontal channel 18 opposite to the upper horizontal surface 16, and two lateral side parts 20 extending between the upper surface 16 and the lower channel 18, which together define a frame surrounding the cores 14 and 15. The cores 14 and 15 extend between the upper surface 16 and the lower channel 18, and are bordered by the side parts 20. Each of the cores 14 and 15 includes a front face 24, a back face 26, and air passages extending from the front face 24 to the back face 26. The front faces 24 and the back faces 26 are framed by the side parts 20, the upper surface 16 and the lower channel 18.

The fan shroud 12 is preferably fitted onto the back faces 26 of the heat exchanger assembly 13 to direct an air flow between the cores 14, 15 and a fan (not shown).

Figure 3:
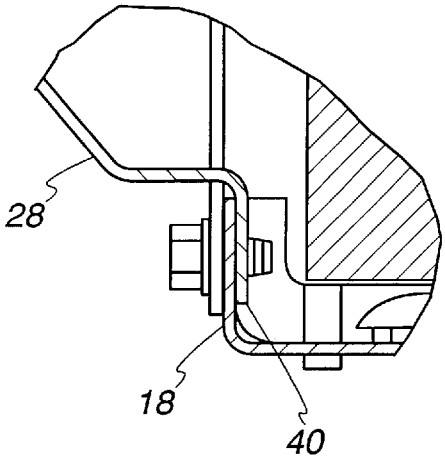
FIG. 3 is a fragmentary view on an enlarged scale taken substantially as indicated along the line 3—3 of FIG. 2.
Figure 4:
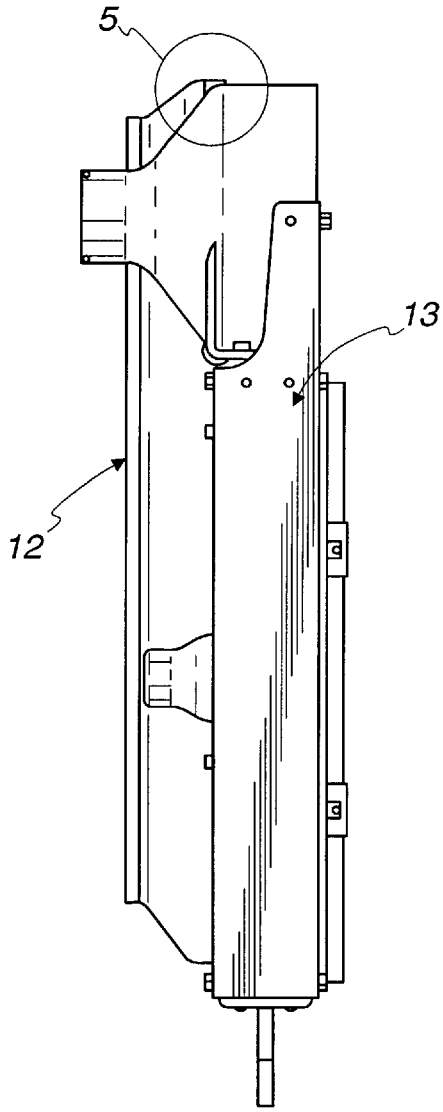
FIG. 4 is an side view of the fan shroud for use with the heat exchanger assembly of FIG. 2.
Figure 5:
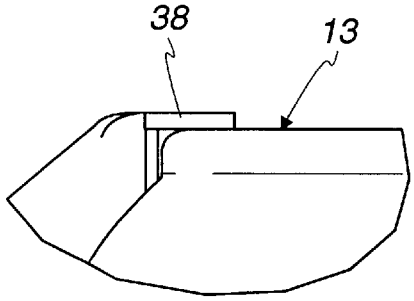
FIG. 5 is an enlarged, fragmentary view taken from circle 5 of FIG. 4.

The fan shroud 12 comprises a covering portion 28 having a shroud body 30 and an opening 32 preferably disposed at the center of the shroud body 30. The opening 32 is of a predetermined size sufficient to receive the fan that draws the air flow through the cores 14 and 15. The covering portion 28 also includes an annular rim 34 extending around the opening 32. There is an upper horizontal flange 38 extending from the covering portion 28. With the fan shroud 12 assembled to the heat exchanger assembly 13, as shown in FIGS. 2, 4 and 5, the upper horizontal flange 38 rests on the upper surface 16 of the heat exchanger assembly 13 to vertically locate the fan shroud 12 relative to the heat exchanger assembly 13. Preferably, the upper horizontal flange 38 is rectangular. A lower vertical flange 40 extends downwardly from the covering portion 28. As shown in FIG. 2, where the fan shroud 12 is assembled to the heat exchanger 13, the lower vertical flange 40 is received in the lower horizontal channel 18 of the heat exchanger assembly 13, as best seen in FIG. 3, to restrict movement of the fan shroud 12 away from the heat exchanger assembly 13. Preferably, the upper horizontal flange 38 extends substantially the length of the core 14.

Referring to FIG. 1, on each side of the fan shroud 12 there are a pair of vertical mounting flanges 44 extending from the covering portion 28. Each of the mounting flanges 44 has an aperture 46 to receive a threaded fastener such as a screw 48 or the like that threadably engages a threaded aperture 49 provided in one of a plurality of mounting plates 50 that are connected with side parts 20 of the heat exchanger assembly 13. The apertures 46 are spaced from the lower vertical flange 40 of the fan shroud 12, and the screws 48 are used to further secure the fan shroud 12 to the heat exchanger assembly 13. It should be appreciated that while four flanges 44 and screws 48 are shown, in some applications it may be advantageous to use more or fewer flanges and/or fasteners, for example, in some applications it may be advantageous to use only two fasteners.

From the foregoing, it should be appreciated that the fan shroud 12 can be easily located on and fixed to the heat exchanger assembly 13 with the lower vertical flange 40 fitted in the channel 18 and the upper horizontal flange 38 resting on the upper surface 16. Additionally, this structure can reduce the number of fasteners, such as screws 48, that are used to further secure the fan shroud 12 to the heat exchanger assembly 13.

What is claimed is:

1. A seif-fixturing fan shroud for use with a heat exchanger assembly including an upper horizontal surface, a lower, upwardly opening, horizontal channel, and at least one core having a front face, a back face, and air flow passages extending from the front face to the back face, the at least one core extending between the upper horizontal surface and the lower horizontal channel, the lower channel defined by a vertical surface extending upwardly from a lower horizontal surface, the shroud comprising:

a covering portion having an opening disposed therethrough, the opening being of a predetermined size sufficient to receive a fan;

an upper horizontal flange extending from the covering portion to rest on the upper horizontal surface of the heat exchanger assembly to vertically locate the fan shroud relative to the heat exchanger assembly, the upper horizontal flange being planar and having a uniform thickness; and a lower vertical flange extending downwardly from the covering portion to be received in the lower horizontal channel of the heat exchanger assembly to restrict movement of the fan shroud away from the heat exchanger assembly, the lower vertical flange being planar and having a uniform thickness.

2. The self-fixturing fan shroud of claim 1 wherein the upper horizontal flange extends substantially the length of the at least one core.

3. A heat exchanger assembly comprising:

an upper horizontal surface;

a lower, upwardly opening, horizontal channel spaced a given distance away from and opposite to the upper horizontal surface, the channel defined by a vertical surface extending upwardly from a lower horizontal surface;

at least one core extending between the upper horizontal surface and the lower horizontal channel having a front face, a back face, and air flow passages extending from the front face to the back face; and a self-fixturing fan shroud to direct air flow between the at least one core and a fan, the shroud including an upper horizontal flange resting on the upper horizontal surface to vertically locate the fan shroud relative to the heat assembly, the upper flange being planar and having a uniform thickness; and a lower vertical flange received in the lower horizontal channel to restrict movement of the fan shroud away from the heat assembly, the lower flange being planar and having a uniform thickness.

4. The heat exchanger assembly of claim 3 wherein the upper horizontal flange of the fan shroud extends substantially the length of the at least one core.

* * * * *